US006277025B1

(12) United States Patent
Margolin

(10) Patent No.: US 6,277,025 B1
(45) Date of Patent: Aug. 21, 2001

(54) LINK KENO GAME

(76) Inventor: Marc Margolin, 6315 Hannum Ave., Culver City, CA (US) 90230

( * ) Notice: Subject to any disclaimer, the term of this patent is extended or adjusted under 35 U.S.C. 154(b) by 0 days.

(21) Appl. No.: 09/671,360

(22) Filed: Sep. 26, 2000

(51) Int. Cl.[7] ..... A63F 9/24
(52) U.S. Cl. ..... 463/18; 463/25
(58) Field of Search ..... 463/15, 16, 18, 463/19, 22, 25, 20, 21

(56) References Cited

U.S. PATENT DOCUMENTS 5,192,076 * 3/1993 Komori ..... 273/138 A
5,727,786 * 3/1998 Weingardt ..... 273/269
5,813,911 * 9/1998 Margolin ..... 463/19

* cited by examiner

*Primary Examiner*—Joe H. Cheng
*Assistant Examiner*—Kim T. Nguyen
(74) *Attorney, Agent, or Firm*—David A. Belasco; Beehler & Pavitt

(57) ABSTRACT

The invention relates to a Keno-type game of chance variation incorporating a means for graphical automated play and calculation of the player's payout. The game includes a playing board divided into a grid of adjoining geometric figures with a surrounding border. Each figure has at least three sides, three corners, or a curvilinear edge. Means for randomly selecting a predetermined number of geometric figures and for identifying their groupings is provided. These groupings include figures having at least one side, corner, side or corner, or curvilinear edge in common with another figure in the grouping. Means for identifying and displaying the grouping containing the largest number of selected figures, for determining the associated payout, and for crediting the payout to a player are provided. A means for sequentially displaying the selected figures identifies and displays a first grouping containing a minimum number of figures. This display is cancelled when a subsequent grouping containing a greater number of figures is identified and displayed. This process is repeated until the predetermined number of selected figures has been reached and a grouping with the largest number of figures is displayed. The grouping is identified by color. A first color is used to display randomly selected figures, a second color displays a grouping having a minimum number of figures, a third color displays the minimum number of figures eligible for payout. The third color displayed cancels out the second color.

24 Claims, 6 Drawing Sheets

LINK KENO GAME

FIELD OF INVENTION

The invention pertains to a game of chance and a device for playing the game. More particularly, the invention relates to a variation on the game of Keno, providing novel, graphically oriented methods of play and means for automating the play and calculating the player's payout.

BACKGROUND OF THE INVENTION

Various types of gaming machines have been developed to provide electronic versions or variations on the casino game known as Keno. U.S. Pat. No. 5,192,076 issued to Komori incorporates a video display and a light pen to select the numbered Keno squares. A display device for illustrating the progress of the selection of random numbers in a given game is included.

U.S. Pat. No. 5,401,024 issued to Simunek, also includes a video display for the Keno game board and further includes slot-machine type "reels" that replace certain numbers on the game board that spin and offer the possibility of additional payouts based on the result of the final position of the spinning reels. U.S. Pat. No. 5,651, 735, issued to Baba provide an electronic means to play a variant Keno game in which a first selection of random Keno balls for a first comparison to the balls selected by the player are followed by a second selection of random Keno balls from those not previously randomly selected. The scores from both rounds are added to determine the player's payout. U.S. Pat. No. Re. 32,480 issued to Bolan discloses a handheld electronic device capable of storing a number of Bingo cards for use during play with letter/number combinations selected during play of the game being manually entered through the devices keyboard. Such a device could be adapted to the game of Keno. U.S. Pat. No. 4,103,895 issued to Pressman et aL is a concealed pattern detection game employing a rectangular display screen and pen-like indicating device for attempting to deduce the concealed pattern. The object is to follow the hidden pattern with the pen device. A similar device could be adapted to selecting square or numbers in a Keno-type game.

While other variations exist, the above-described designs for Keno-type gaming machines are typical of those encountered in the prior art. It is an objective of the present invention to provide for a new and entertaining variant on the Keno game. It is a further objective to provide this game in a format that is fast and easy to play while holding the interest of the player. It is a still further objective of the invention to provide the above-described capabilities in an inexpensive and durable device that is capable of extended duty cycles and that may be easily repaired and maintained. It is yet a further objective to provide a variety of different games and payouts using the same device.

While some of the objectives of the present invention are disclosed in the prior art, none of the inventions found include all of the requirements identified.

SUMMARY OF THE INVENTION

The present invention relates to a Keno-type game of chance with variations incorporating a means for graphical, automated play and calculation of the player's payout.

The game includes a playing board. The board is divided into a grid of adjoining geometric figures. This grid has at least three borders. Each of these figures has at least three sides.

A means for randomly selecting a predetermined number of these figures is provided. Also provided is a means for identifying groupings of the selected figures. These groupings include figures having at least one side in common with another figure in the grouping. A means for identifying and displaying the grouping containing the largest number of selected figures is also included. A means for determining a payout associated with the displayed grouping is provided as is a means for crediting the payout to a player.

In a further variation of the invention the geometric figures are rectangles.

In another variation the means for randomly selecting a predetermined number of figures includes a means for sequentially displaying the selected figures. A means for identifying and displaying a first grouping containing at least a minimum number of figures is also provided. Also included is a means for canceling the display of the first grouping when a subsequent grouping is identified that contains a greater number of figures than the first grouping. A means for displaying the subsequent grouping is provided. A means for identifying and displaying further groupings until the predetermined number of selected figures has been displayed is also included in this variation. Each of the further groupings includes a greater number of figures than the previously displayed groupings. Finally, a means for canceling the display of the previously displayed groupings is included in this variation.

In yet another variation of the invention, the identification of the randomly selected figures is in a first color, the identification of a grouping having at least the minimum number of figures is displayed in a second color and the identification of a grouping having at least the minimum number of figures eligible for a payout is displayed in a third color. The second color display is canceled upon the display of a larger grouping or of the third color.

In still another variation of the invention, a grouping may extend beyond one of the borders of the grid, wrapping around a second border of the grid and still be considered as a single grouping.

In a different variation of the invention, an additional payout is associated with any grouping extending between adjacent or opposite borders.

In a further variation of the invention, the game includes a playing board. The board is divided into a grid of adjoining geometric figures. This grid has at least three borders. Each of these figures has at least three comers.

A means for randomly selecting a predetermined number of these figures is provided. Also provided is a means for identifying groupings of the selected figures. These groupings include figures having at least one corner and no sides in common with another figure in the grouping. A means for identifying and displaying the grouping containing the largest number of selected figures is also incorporated. A means for determining a payout associated with the displayed grouping is provided as is a means for crediting the payout to a player.

In an additional variation of the invention, the regular geometric figures are rectangles.

In yet another variation, the means for randomly selecting a predetermined number of figures includes a means for sequentially displaying the selected figures. A means for identifying and displaying a first grouping containing at least a minimum number of figures is also provided. Also included is a means for canceling the display of the first grouping when a subsequent grouping is identified that contains a greater number of figures than the first grouping.

A means for displaying the subsequent grouping is provided. A means for identifying and displaying further groupings until the predetermined number of selected figures has been displayed is also included in this variation. Each of the further groupings includes a greater number of figures than the previously displayed groupings. Finally, a means for canceling the display of the previously displayed groupings is included in this variation.

In a still further variation of the invention, the identification of the randomly selected figures is in a first color, the identification of a grouping having at least the minimum number of figures is displayed in a second color and the identification of a grouping having at least the minimum number of figures eligible for a payout is displayed in a third color. The second color display is canceled upon the display of a larger grouping or of the third color.

In still an additional variation of the invention, a grouping may extend beyond one of the borders of the grid, wrapping around a second border of the grid and still be considered as a single grouping.

In a still different variation of the invention, an additional payout is associated with any grouping extending between adjacent or opposite borders.

In another version of the invention, the game includes a playing board. The board is divided into a grid of adjoining geometric figures. This grid has at least three borders. Each of these figures has at least three sides and at least three comers.

A means for randomly selecting a predetermined number of these figures is provided. Also provided is a means for identifying groupings of the selected figures. These groupings include figures having at least one side or one comer in common with another figure in the grouping. A means for identifying and displaying the grouping containing the largest number of selected figures is also incorporated. A means for determining a payout associated with the displayed grouping is provided as is a means for crediting the payout to a player.

In an additional version of the invention, the regular geometric figures are rectangles.

In yet an additional version of the invention, the means for randomly selecting a predetermined number of figures includes a means for sequentially displaying the selected figures. A means for identifying and displaying a first grouping containing at least a minimum number of figures is also provided. Also included is a means for canceling the display of the first grouping when a subsequent grouping is identified that contains a greater number of figures than the first grouping. A means for displaying the subsequent grouping is provided. A means for identifying and displaying further groupings until the predetermined number of selected figures has been displayed is also included in this variation. Each of the further groupings includes a greater number of figures than the previously displayed groupings. Finally, a means for canceling the display of the previously displayed groupings is included in this variation.

In a still further version of the invention, the identification of the randomly selected figures is in a first color, the identification of a grouping having at least the minimum number of figures is displayed in a second color and the identification of a grouping having at least the minimum number of figures eligible for a payout is displayed in a third color. The second color display is canceled upon the display of a larger grouping or of the third color.

In still an additional version of the invention, a grouping may extend beyond one of the borders of the grid, wrapping around a second border of the grid and still be considered as a single grouping.

In a still different version of the invention, an additional payout is associated with any grouping extending between adjacent or opposite borders.

In a further version of the invention, the game includes a playing board. The board is divided into a grid of adjoining geometric figures. This grid has at least three borders. Each of these figures has a curvilinear edge. A means for randomly selecting a predetermined number of these figures is provided. Also provided is a means for identifying groupings of the selected figures. These groupings include figures having at least one point in common with another figure in the grouping. A means for identifying and displaying the grouping containing the largest number of selected figures is also incorporated. A means for determining a payout associated with the displayed grouping is provided as is a means for crediting the payout to a player.

In an additional variation of the invention, the regular geometric figures are ellipses.

In yet an additional variation of the invention, the means for randomly selecting a predetermined number of figures includes a means for sequentially displaying the selected figures. A means for identifying and displaying a first grouping containing at least a minimum number of figures is also provided. Also included is a means for canceling the display of the first grouping when a subsequent grouping is identified that contains a greater number of figures than the first grouping. A means for displaying the subsequent grouping is provided as well. A means for identifying and displaying further groupings until the predetermined number of selected figures has been displayed is also included in this variation. Each of the further groupings includes a greater number of figures than the previously displayed groupings. Finally, a means for canceling the display of the previously displayed groupings is included in this variation.

In a still further variation of the invention, the identification of the randomly selected figures is in a first color, the identification of a grouping having at least the minimum number of figures is displayed in a second color and the identification of a grouping having at least the minimum number of figures eligible for a payout is displayed in a third color. The second color display is canceled upon the display of a larger grouping or of the third color.

In still an additional variation of the invention, a grouping may extend beyond one of the borders of the grid, wrapping around a second border of the grid and still be considered as a single grouping.

In a final variation of the invention, an additional payout is associated with any grouping extending between adjacent or opposite borders.

An appreciation of the other aims and objectives of the present invention and an understanding of it may be achieved by referring to the accompanying drawings and the detailed description of a preferred embodiment.

DETAILED DESCRIPTION OF THE PREFERRED EMBODIMENT

Figure 1:
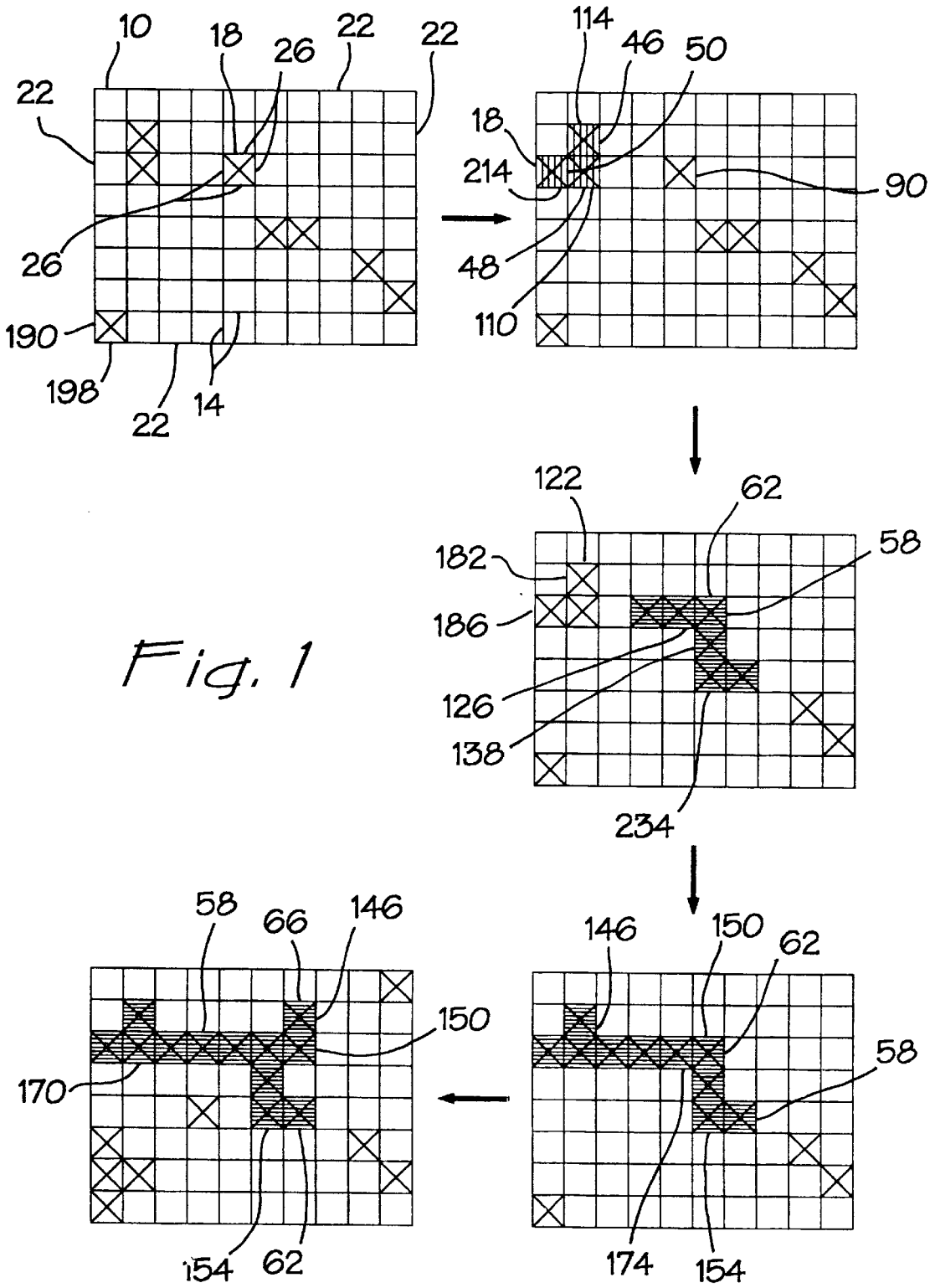
FIG. 1 is a schematic view of the preferred embodiment of the invention illustrating a payout for groupings in which the figures have adjacent sides in common.

As illustrated in FIG. 1, the game includes a playing board 10. The board 10 is divided into a grid 14 of adjoining geometric figures 18. This grid 14 has at least three borders 22. Each of these figures 18 has at least three sides 26.

A means for randomly selecting a predetermined number of these figures 18 is provided. Also provided is a means for identifying groupings 46 of the selected figures 18. These groupings 46 include figures 18 having at least one side 50 in common with another figure in the grouping 48. A means for identifying 58 and displaying 62 the grouping containing the largest number of selected figures 66 is also included. A means for determining a payout associated with the displayed grouping is provided as is a means for crediting the payout to a player.

In another variation of the invention the geometric figures 18 are rectangles 90.

In yet another variation the means for randomly selecting a predetermined number of figures includes a means for sequentially displaying the selected figures. A means for identifying and displaying a first grouping 114 containing at least a minimum number of figures is also provided. Also included is a means for canceling the display 122 of the first grouping 114 when a subsequent grouping 126 is identified that contains a greater number of figures than the first grouping 114. A means for displaying the subsequent grouping 138 is provided. A means for identifying and displaying further groupings 154 until the predetermined number of selected figures has been displayed is also included in this variation. Each of the further groupings 154 includes a greater number of figures 170 than the previously displayed groupings 174. Finally, a means for canceling the display 182 of the previously displayed groupings is included in this variation.

In still another variation of the invention, the identification 190 of the randomly selected figures is in a first color 198, the identification of a grouping having at least the minimum number of figures is displayed in a second color 214 and the identification of a grouping having at least the minimum number of figures eligible for a payout is displayed in a third color 234. The second color display 214 is canceled 122 upon the display of a larger grouping 216 or of the third color 234.

Figure 4A:
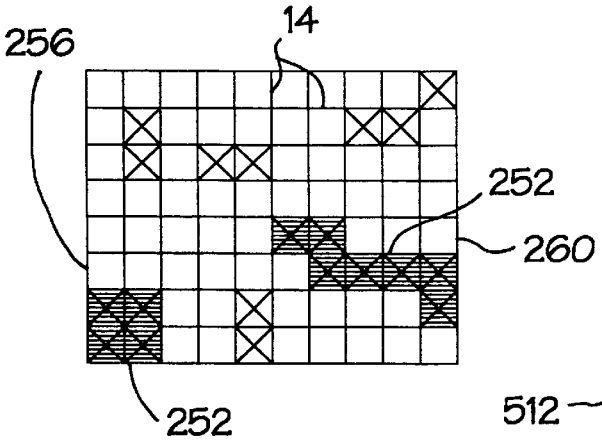
FIGS. 4A–4D is a schematic view of the preferred embodiment illustrating a payout for a grouping that extends beyond one border of the game board and wraps around another.

In still another variation of the invention shown in FIG. 4A, a grouping 252 may extend beyond one of the borders 256 of the grid 14, wrapping around a second border 260 of the grid 14 and still be considered as a single grouping 252.

Figure 5A:
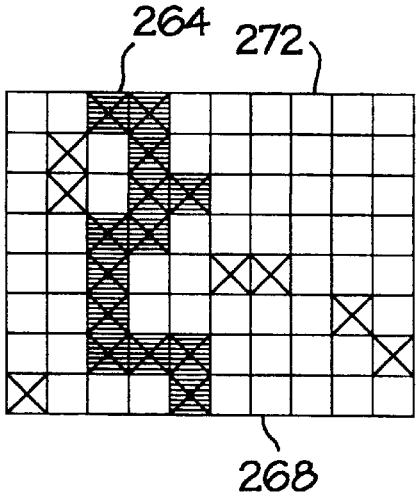
FIGS. 5A–5D is a schematic view of the preferred embodiment illustrating a payout for a grouping that extends from one border to another.

In a different variation of the invention as displayed in FIG. 5A, an additional payout is associated with any grouping 264 extending between adjacent 268 or opposite borders 272.

Figure 2:
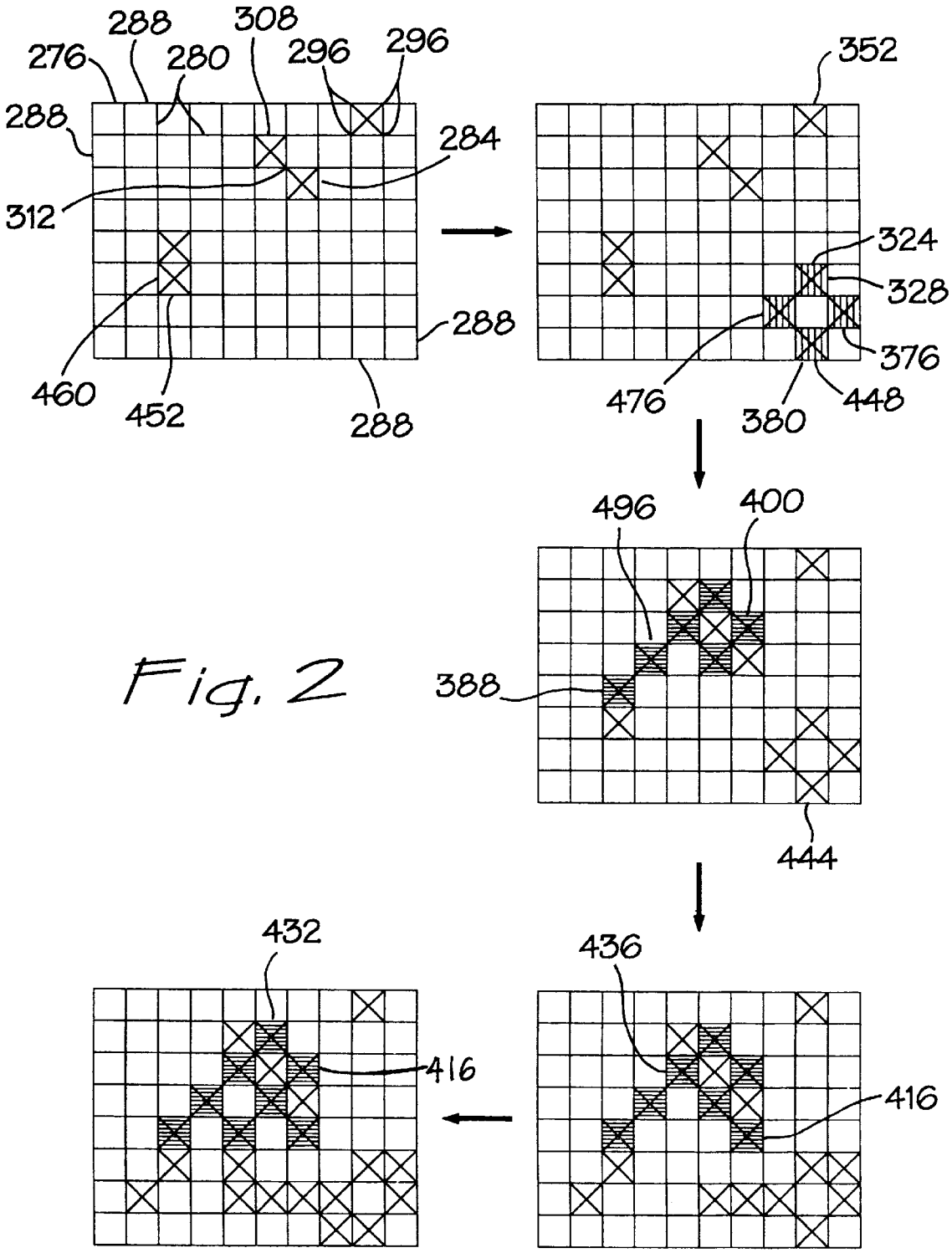
FIG. 2 is a schematic view of the preferred embodiment illustrating a payout for groupings in which the figures have adjacent comers in common.

In a further variation of the invention as depicted in FIG. 2, the game includes a playing board 276. The board 276 is divided into a grid 280 of adjoining geometric figures 284. This grid 280 has at least three borders 288. Each of these figures 284 has at least three comers 296.

A means for randomly selecting a predetermined number of these figures 284 is provided. Also provided is a means for identifying groupings 308 of the selected figures 284. These groupings 308 include figures 284 having at least one comer and no sides 312 in common with another figure in the grouping. A means for identifying and displaying the grouping containing the largest number of selected figures 328 is also incorporated. A means for determining a payout associated with the displayed grouping is provided as is a means for crediting the payout to a player.

In another different variation, the regular geometric figures 284 are rectangles 352.

In yet an additional variation of the invention, the means for randomly selecting a predetermined number of figures includes a means for sequentially displaying the selected figures. A means for identifying and displaying a first grouping containing at least a minimum number of figures 380 is also provided. Also included is a means for canceling the display of the first grouping 380 when a subsequent grouping 388 is identified that contains a greater number of figures than the first grouping 380. A means for displaying the subsequent grouping 400 is provided. A means for identifying and displaying further groupings 416 until the predetermined number of selected figures has been displayed is also included in this variation. Each of the further groupings 416 includes a greater number of figures 432 than the previously displayed groupings 436. Finally, a means for canceling the display 444 of the previously displayed groupings 448 is included in this variation.

In a still further variation of the invention, the identification of the randomly selected figures is in a first color 460, the identification of a grouping having at least the minimum number of figures is displayed in a second color 476 and the identification of a grouping having at least the minimum number of figures eligible for a payout is displayed in a third color 496. The second color display 476 is canceled 444 upon the display of a larger grouping 478 or of the third color 496.

Figure 4B:
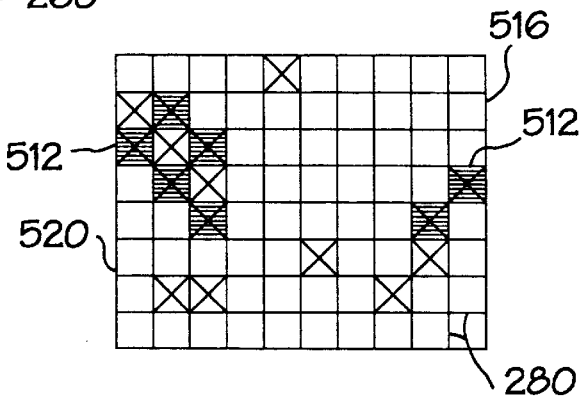

In still an additional variation of the invention as illustrated in FIG. 4B, a grouping 512 may extend beyond one of the borders 516 of the grid 280, wrapping around a second border 520 of the grid and still be considered as a single grouping 512.

Figure 5B:
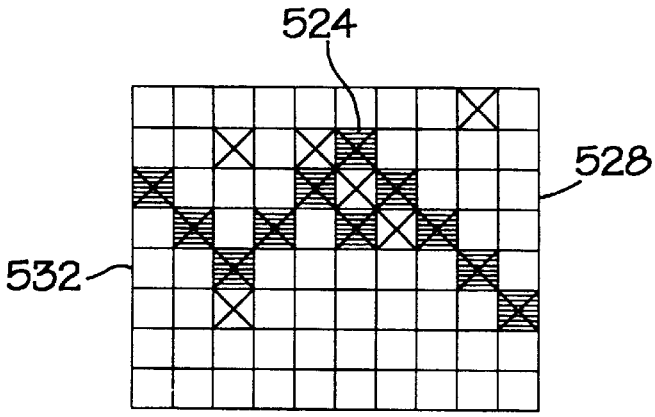

In a still different variation of the invention as depicted in FIG. 5B, an additional payout is associated with any grouping 524 extending between adjacent 528 or opposite borders 532.

Figure 3:
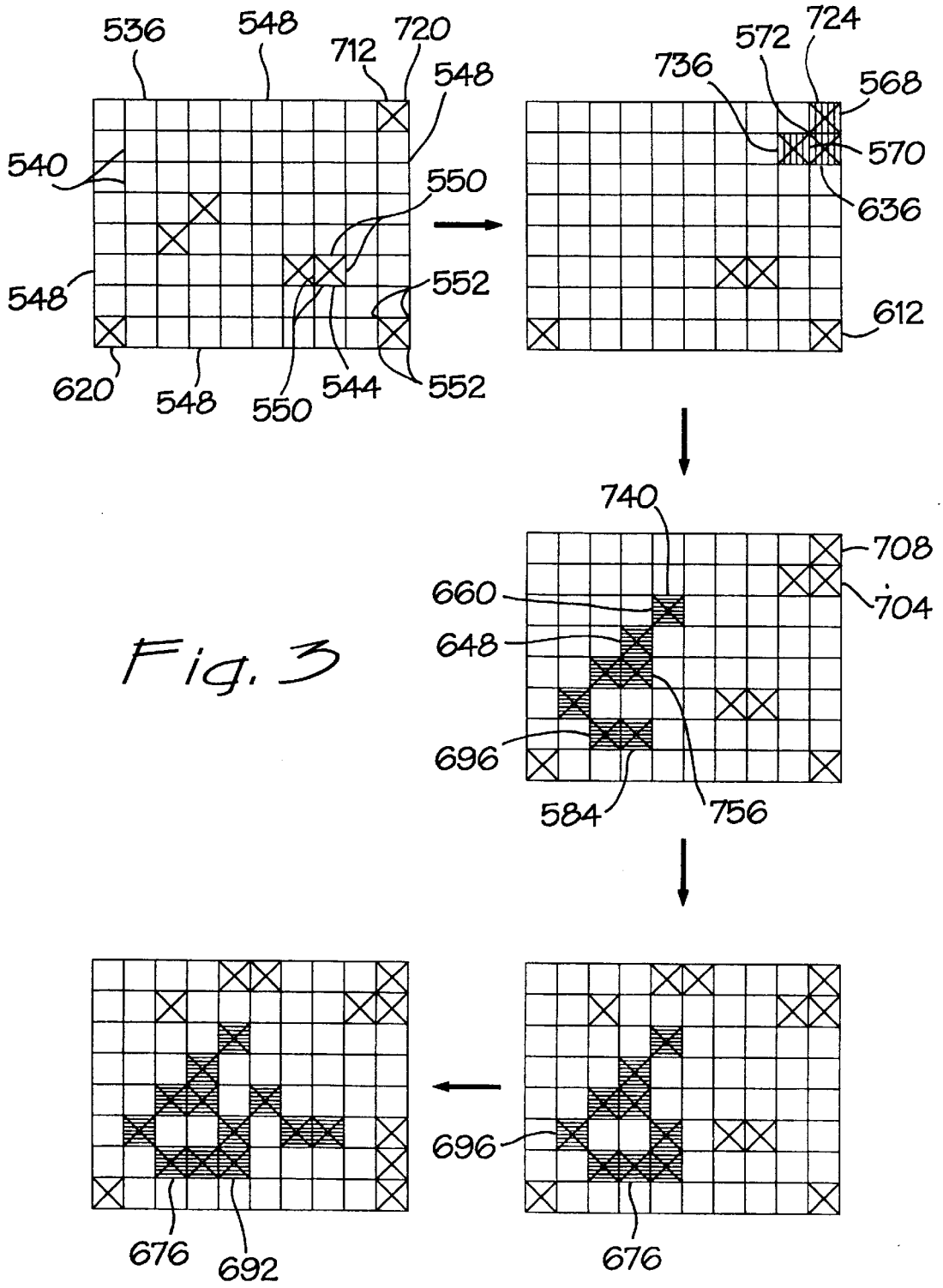
FIG. 3 is a schematic view of the preferred embodiment illustrating a payout for groupings in which the figures have adjacent sides or comers in common.

In another version of the invention as displayed in FIG. 3, the game includes a playing board 536. The board 536 is divided into a grid 540 of adjoining geometric figures 544. This grid 540 has at least three borders 548. Each of these figures 544 has at least three sides 550 and at least three corners 552.

A means for randomly selecting a predetermined number of these figures 544 is provided. Also provided is a means for identifying groupings 568 of the selected figures 544. These groupings 568 include figures 544 having at least one side 570 or one corner 572 in common with another figure in the grouping. A means for identifying and displaying the grouping containing the largest number of selected figures 588 is also incorporated. A means for determining a payout associated with the displayed grouping is provided as is a means for crediting the payout to a player.

As illustrated in FIG. 3, in an additional version of the invention, the regular geometric figures 544 are rectangles 612.

In yet an additional version of the invention, the means for randomly selecting a predetermined number of figures includes a means for sequentially displaying the selected figures 620. A means for identifying and displaying a first grouping containing at least a minimum number of figures 640 is also provided. Also included is a means for canceling the display of the first grouping 636 when a subsequent grouping 648 is identified that contains a greater number of figures than the first grouping 636. A means for displaying the subsequent grouping 660 is provided. A means for identifying and displaying further groupings 676 until the predetermined number of selected figures has been displayed is also included in this variation. Each of the further groupings 676 includes a greater number of figures 692 than the previously displayed groupings 696. Finally, a means for canceling the display 704 of the previously displayed groupings is included in this variation.

In a still further version of the invention, the identification 712 of the randomly selected figures is in a first color 720, the identification of a grouping having at least the minimum number of figures is displayed in a second color 736 and the identification of a grouping having at least the minimum number of figures eligible for a payout is displayed in a third color 756. The second color display 736 is canceled 704 upon the display of a larger grouping 738 or of the third color 756.

Figure 4C:
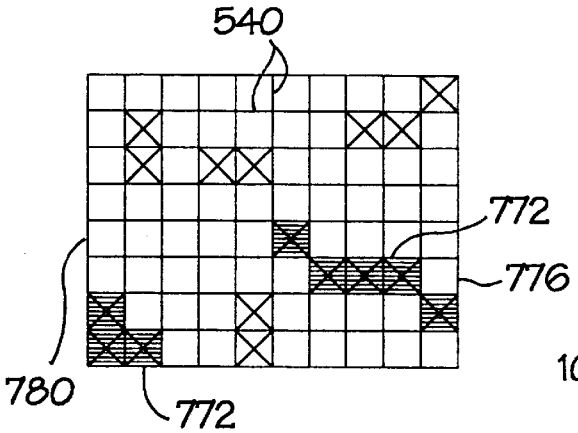

In still an additional version of the invention as illustrated in FIG. 4C, a grouping 772 may extend beyond one of the borders 776 of the grid 540, wrapping around a second border 780 of the grid 540 and still be considered as a single grouping 772.

Figure 5C:
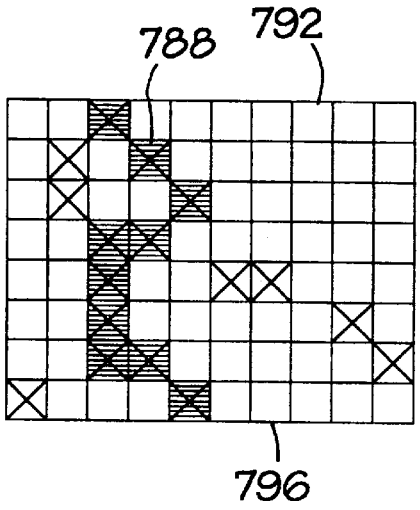

In a still different version of the invention shown in FIG. 5C, an additional payout is associated with any grouping 788 extending between adjacent 792 or opposite borders 796.

Figure 6:
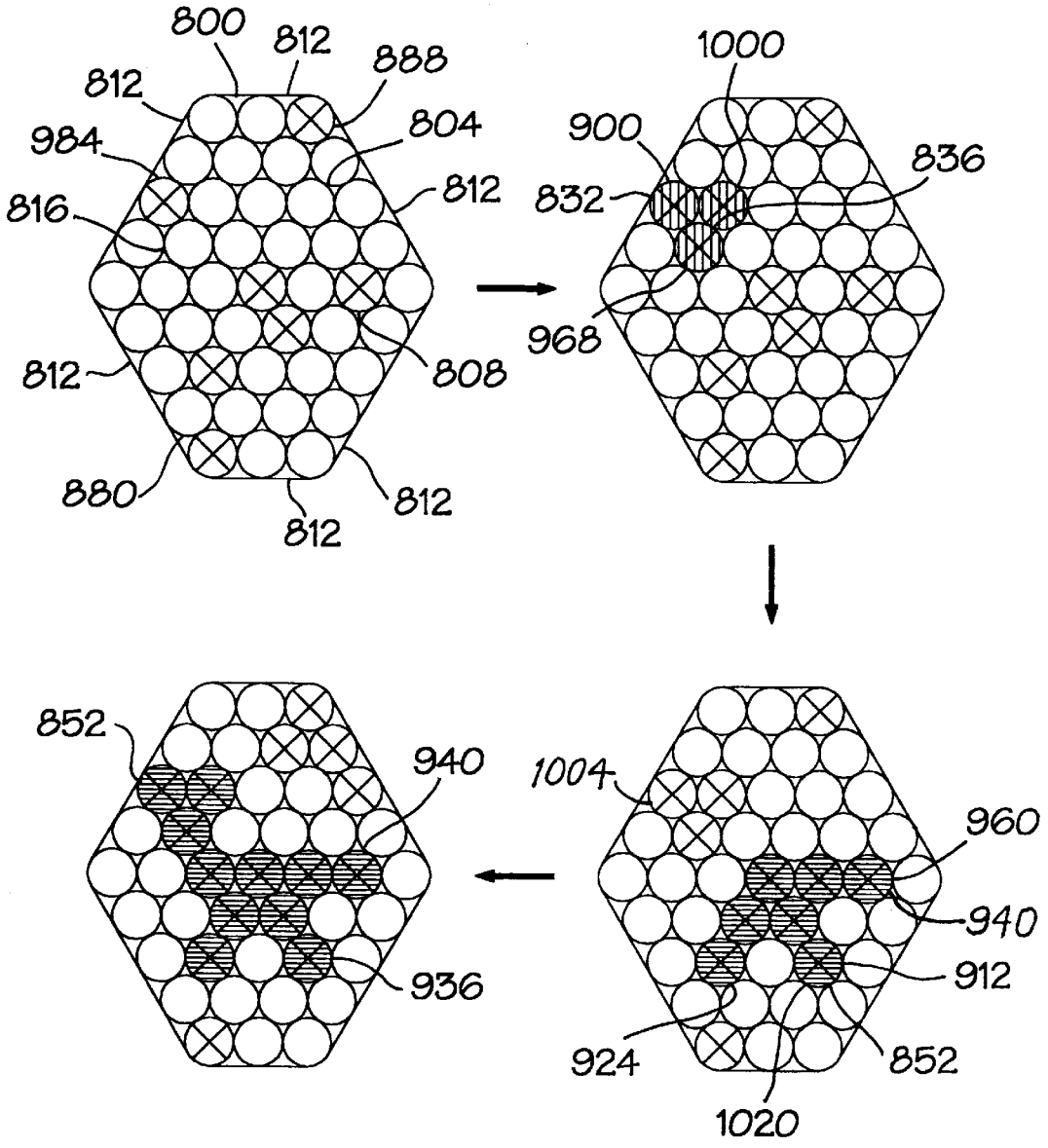
FIG. 6 is a schematic view of the preferred embodiment of the invention illustrating figures with curvilinear edges and a payout for groupings in which adjacent figures have at least one point in common.

In a further version of the invention as displayed in FIG. 6, the game includes a playing board 800. The board 800 is divided into a grid 804 of adjoining geometric figures 808. This grid 804 has at least three borders 812. Each of these figures has a curvilinear edge 816. A means for randomly selecting a predetermined number of these figures 808 is provided. Also provided is a means for identifying groupings 832 of the selected figures 808. These groupings 832 include figures 808 having at least one point 836 in common with another figure in the grouping. A means for identifying and displaying 852 the grouping containing the largest number of selected figures is also incorporated. A means for determining a payout associated with the displayed grouping is provided as is a means for crediting the payout to a player.

In an additional variation of the invention, the regular geometric figures 808 are ellipses 880.

In yet an additional variation of the invention, the means for randomly selecting a predetermined number of figures includes a means for sequentially displaying the selected figures 888. A means for identifying and displaying a first grouping 900 containing at least a minimum number of figures is also provided. Also included is a means for canceling the display of the first grouping 900 when a subsequent grouping 912 is identified that contains a greater number of figures than the first grouping 900. A means for displaying the subsequent grouping 924 is provided as well. A means for identifying and displaying 936 further groupings 940 until the predetermined number of selected figures has been displayed is also included in this variation. Each of the further groupings 940 includes a greater number of figures than the previously displayed groupings 960. Finally, a means for canceling the display 968 of the previously displayed groupings is included in this variation.

In a still further variation of the invention, the identification of the randomly selected figures is in a first color 984, the identification of a grouping having at least the minimum number of figures is displayed in a second color 1000 and the identification of a grouping having at least the minimum number of figures eligible for a payout is displayed in a third color 1020. The second color display 1000 is canceled 1004 upon the display of a larger grouping 1002 or of the third color 1020.

Figure 4D:
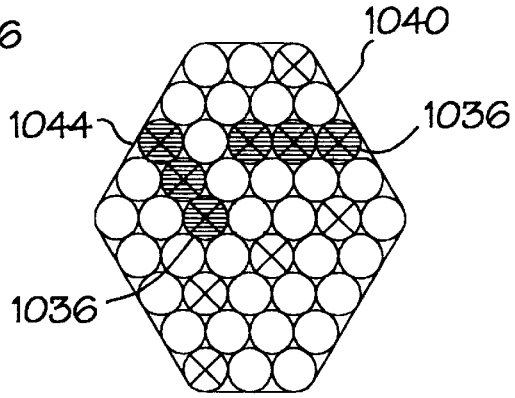

In still an additional variation of the invention as depicted in FIG. 4D, a grouping 1036 may extend beyond one of the borders 1040 of the grid 804, wrapping around a second border 1044 of the grid 804 and still be considered as a single grouping 1036.

Figure 5D:
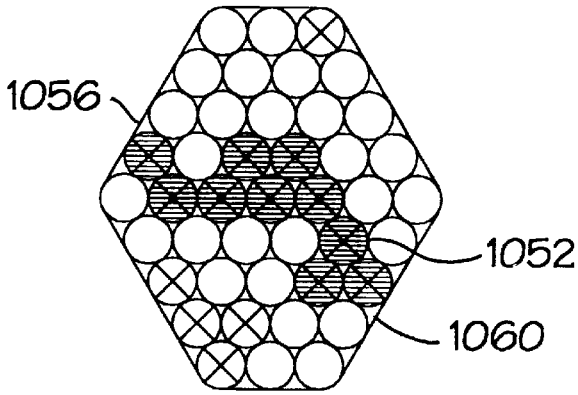

In a final variation of the invention as displayed in FIG. 5D, an additional payout is associated with any grouping 1052 extending between adjacent 1056 or opposite borders 1060.

The game has been described with reference to particular embodiments. Other modifications and enhancements can be made without departing from the spirit and scope of the claims that follow.

What is claimed is:

1. A game, comprising:

a playing board, said board being divided into a grid of adjoining geometric figures, said grid having at least three borders, each of said figures having at least three sides;

means for randomly selecting a predetermined number of said figures;

means for identifying groupings of said selected figures, said groupings including figures having at least one side in common with another figure in the grouping;

means for identifying and displaying the grouping containing the largest number of selected figures;

means for determining a payout associated with the displayed grouping; and means for crediting the payout to a player.

2. A game, as described in claim 1, wherein the geometric figures are rectangles.

3. A game, as described in claim 1, wherein the means for randomly selecting a predetermined number of figures further includes:

means for sequentially displaying the selected figures;

means for identifying and displaying a first grouping containing at least a minimum number of figures;

means for canceling the display of said first grouping when a subsequent grouping is identified, said subsequent grouping including a greater number of figures than said first grouping;

means for displaying said subsequent grouping;

means for identifying and displaying further groupings until the predetermined number of selected figures has been displayed, each of said further groupings including a greater number of figures than previously displayed groupings; and means for canceling the display of said previously displayed groupings.

4. A game, as described in claim 3, wherein the identification of the randomly selected figures is in a first color, the identification of a grouping having at least the minimum number of figures is displayed in a second color and the identification of a grouping having at least the minimum number of figures eligible for a payout is displayed in a third color, said second color display being canceled upon the display either of a larger grouping and said third color.

5. A game, as described in claim 1, wherein a grouping may extend beyond one of the boarders of the grid, wrap around a second boarder of the grid and be considered as a single grouping.

6. A game, as described in claim 1, wherein an additional payout is associated with any grouping extending between one of adjacent and opposite boarders.

7. A game, comprising:

a playing board, said board being divided into a grid of adjoining geometric figures, said grid having at least three boarders, each of said figures having at least three comers;

means for randomly selecting a predetermined number of said figures;

means for identifying groupings of said selected figures, said groupings including figures having at least one corner and no sides in common with another figure in the grouping;

means for identifying and displaying groupings containing at least a minimum number of selected figures;

means for determining a payout associated with each displayed grouping; and means for crediting each payout to a player.

8. A game, as described in claim 7, wherein the regular geometric figures are rectangles.

9. A game, as described in claim 7, wherein the means for randomly selecting a predetermined number of figures further includes:

means for sequentially displaying the selected figures;

means for identifying and displaying a first grouping containing at least a minimum number of figures;

means for canceling the display of said first grouping when a subsequent grouping is identified, said subsequent grouping including a greater number of figures than said first grouping;

means for displaying said subsequent grouping;

means for identifying and displaying further groupings until the predetermined number of selected figures has been displayed, each of said further groupings including a greater number of figures than previously displayed groupings; and means for canceling the display of said previously displayed groupings.

10. A game, as described in claim 9, wherein the identification of the randomly selected figures is in a first color, the identification of a grouping having at least the minimum number of figures is displayed in a second color and the identification of a grouping having at least the minimum number of figures eligible for a payout is displayed in a third color, said second color display being canceled upon the display either of a larger grouping and said third color.

11. A game, as described in claim 7, wherein a grouping may extend beyond one of the boarders of the grid, wrap around a second boarder of the grid and be considered as a single grouping.

12. A game, as described in claim 7, wherein an additional payout is associated with any grouping extending between one of adjacent and opposite boarders.

13. A game, comprising:

a playing board, said board being divided into a grid of adjoining, geometric figures, said grid having at least three borders, each of said figures having at least three sides and at least three comers;

means for randomly selecting a predetermined number of said figures;

means for identifying groupings of said selected figures, said groupings including figures having one of at least one side and at least one corner in common with another figure;

means for identifying and displaying the grouping containing the largest number of selected figures;

means for determining a payout associated with the displayed grouping; and means for crediting the payout to a player.

14. A game, as described in claim 13, wherein the geometric figures are rectangles.

15. A game, as described in claim 13, wherein the means for randomly selecting a predetermined number of figures further includes:

means for sequentially displaying the selected figures;

means for identifying and displaying a first grouping containing at least a minimum number of figures;

means for canceling the display of said first grouping when a subsequent grouping is identified, said subsequent grouping including a greater number of figures than said first grouping;

means for displaying said subsequent grouping;

means for identifying and displaying further groupings until the predetermined number of selected figures has been displayed, each of said further groupings including a greater number of figures than previously displayed groupings; and means for canceling the display of said previously displayed groupings.

16. A game, as described in claim 15, wherein the identification of the randomly selected figures is in a first color, the identification of a grouping having at least the minimum number of figures is displayed in a second color and the identification of a grouping having at least the minimum number of figures eligible for a payout is displayed in a third color, said second color display being canceled upon the display either of a larger grouping and said third color.

17. A game, as described in claim 13, wherein a grouping may extend beyond one of the borders of the grid, wrap around a second border of the grid and be considered as a single grouping.

18. A game, as described in claim 13, wherein an additional payout is associated with any grouping extending between one of adjacent and opposite edges.

19. A game, comprising:

a playing board, said board being divided into a grid of adjoining, geometric figures, said grid having at least one surrounding border, each of said figures having a curvilinear edge;

means for randomly selecting a predetermined number of said figures;

means for identifying groupings of said selected figures, said groupings including figures having one of at least one point of contact in common with another figure;

means for identifying and displaying the grouping containing the largest number of selected figures;

means for determining a payout associated with the displayed grouping; and means for crediting the payout to a player.

20. A game, as described in claim 19, wherein the geometric figures are ellipses.

21. A game, as described in claim 19, wherein the means for randomly selecting a predetermined number of figures further includes:

means for sequentially displaying the selected figures;

means for identifying and displaying a first grouping containing at least a minimum number of figures;

means for canceling the display of said first grouping when a subsequent grouping is identified, said subsequent grouping including a greater number of figures than said first grouping;

means for displaying said subsequent grouping;

means for identifying and displaying further groupings until the predetermined number of selected figures has been displayed, each of said further groupings including a greater number of figures than previously displayed groupings; and means for canceling the display of said previously displayed groupings.

22. A game, as described in claim 21, wherein the identification of the randomly selected figures is in a first color, the identification of a grouping having at least the minimum number of figures is displayed in a second color and the identification of a grouping having at least the minimum number of figures eligible for a payout is displayed in a third color, said second color display being canceled upon the display either of a larger grouping and said third color.

23. A game, as described in claim 19, wherein a grouping may extend beyond one of the boarders of the grid, wrap around a second boarder of the grid and be considered as a single grouping.

24. A game, as described in claim 19, wherein an additional payout is associated with any grouping extending between one of adjacent and opposite boarders.

* * * * *